US009744539B2

(12) United States Patent
Lai

(10) Patent No.: US 9,744,539 B2
(45) Date of Patent: Aug. 29, 2017

(54) CONTAINER CLEANING DEVICE

(71) Applicant: Chun-Liang Lai, Zhubei (TW)

(72) Inventor: Chun-Liang Lai, Zhubei (TW)

( * ) Notice: Subject to any disclaimer, the term of this patent is extended or adjusted under 35 U.S.C. 154(b) by 87 days.

(21) Appl. No.: 14/727,954

(22) Filed: Jun. 2, 2015

(65) Prior Publication Data

US 2015/0360266 A1 Dec. 17, 2015

(30) Foreign Application Priority Data

Jun. 17, 2014 (TW) ..... 103210601 U

(51) Int. Cl.

| | |
|---|---|
| ***B05B 1/02*** | (2006.01) |
| ***B05B 1/14*** | (2006.01) |
| ***B05B 1/26*** | (2006.01) |
| ***B08B 9/08*** | (2006.01) |
| ***B08B 9/093*** | (2006.01) |

(52) U.S. Cl.

CPC ..... *B05B 1/02* (2013.01); *B05B 1/14* (2013.01); *B05B 1/267* (2013.01); *B08B 9/0813* (2013.01); *B08B 9/0936* (2013.01)

(58) Field of Classification Search

None

See application file for complete search history.

(56) References Cited

U.S. PATENT DOCUMENTS 5,522,412 A * 6/1996 Ohba ..... H01L 21/67051 118/70
7,107,998 B2 * 9/2006 Greer ..... C23C 16/16 134/1.2
2005/0284369 A1 * 12/2005 Miya ..... H01L 21/67751 118/500
2007/0272287 A1 * 11/2007 Cirette ..... B08B 9/32 134/142

FOREIGN PATENT DOCUMENTS

JP 04056770 A * 2/1992 ..... C23C 16/4405

* cited by examiner

*Primary Examiner* — Michael Barr
*Assistant Examiner* — Cristi Tate-Sims
(74) *Attorney, Agent, or Firm* — Alan D. Kamrath; Kamrath IP Lawfirm, P.A.

(57) ABSTRACT

A container cleaning device includes a mounting plate shaped for accommodating a wafer; and a nozzle assembly disposed on the mounting plate and including a base and a shell complimentarily disposed on the base. The shell includes an inlet and at least one outlet member disposed on an edge. The base includes a recess communicating with the inlet, and at least one outlet element each being inclined at a predetermined angle with respect to the shell. Each outlet member of the shell is adjacent to and communicates with the corresponding outlet element of the base.

10 Claims, 6 Drawing Sheets

CONTAINER CLEANING DEVICE

BACKGROUND OF THE INVENTION

1. Field of the Invention

The invention relates to cleaning devices and more particularly to a device for cleaning a container after wafers have been polished therein.

2. Description of Related Art

In thin films producing process, such as CVD (chemical vapor deposit), PVD (physical vapor deposit), electroplating, and photo resist coating, chemicals or metal particles may deposit on the non-pattern back and sides of a wafer as pollutants. The pollutants may pollute the arms of an employee and damage the machine in the process. Thus, wafer cleaning is a required step after producing wafers.

As shown in FIGS. 6 and 7, a conventional wafer cleaning device 9 is shown and includes an open container 91, a cover 92 adapted to put on the container 91, a support 93 in the container 91, and a nozzle 94. After polishing wafers 8, they are loaded onto the support 93. In the cleaning step, the support 93 rotates in high speed to rotate the wafers 8. Also, cleaning solution 95 leaves the nozzle 94 to strike the wafers 8, thereby removing unwanted particles. After the cleaning, the cleaning solution 95 and the unwanted particles flow out of the container 91.

However, the conventional container cleaning device 9 suffers a drawback. In detail, the cleaning solution 95 and the unwanted particles may spatter on the inner surface of the container 91 due to high speed rotation of the support 931. As a result, scale 911 may form on the inner surface of the container 91 after a number of times of cleaning operation. Thus, it is necessary to clean the container cleaning device 9. It inevitably wastes time and increases the production cost.

Thus, the need for effectively flowing the cleaning solution 95 and the unwanted particles out of the container 91 and thus greatly decrease the number of cleaning exists.

SUMMARY OF THE INVENTION

It is therefore one object of the invention to provide a container cleaning device comprising a mounting plate shaped for accommodating a wafer; and a nozzle assembly disposed on the mounting plate and including a base and a shell complimentarily disposed on the base; wherein the shell includes an inlet and at least one outlet member disposed on an edge; wherein the base includes a recess communicating with the inlet, and at least one outlet element each being inclined at a predetermined angle with respect to the shell; and wherein each of the at least one outlet member of the shell is adjacent to and communicates with each of the at least one outlet element of the base.

The above and other objects, features and advantages of the invention will become apparent from the following detailed description taken with the accompanying drawings.

DETAILED DESCRIPTION OF THE INVENTION

Figure 1:
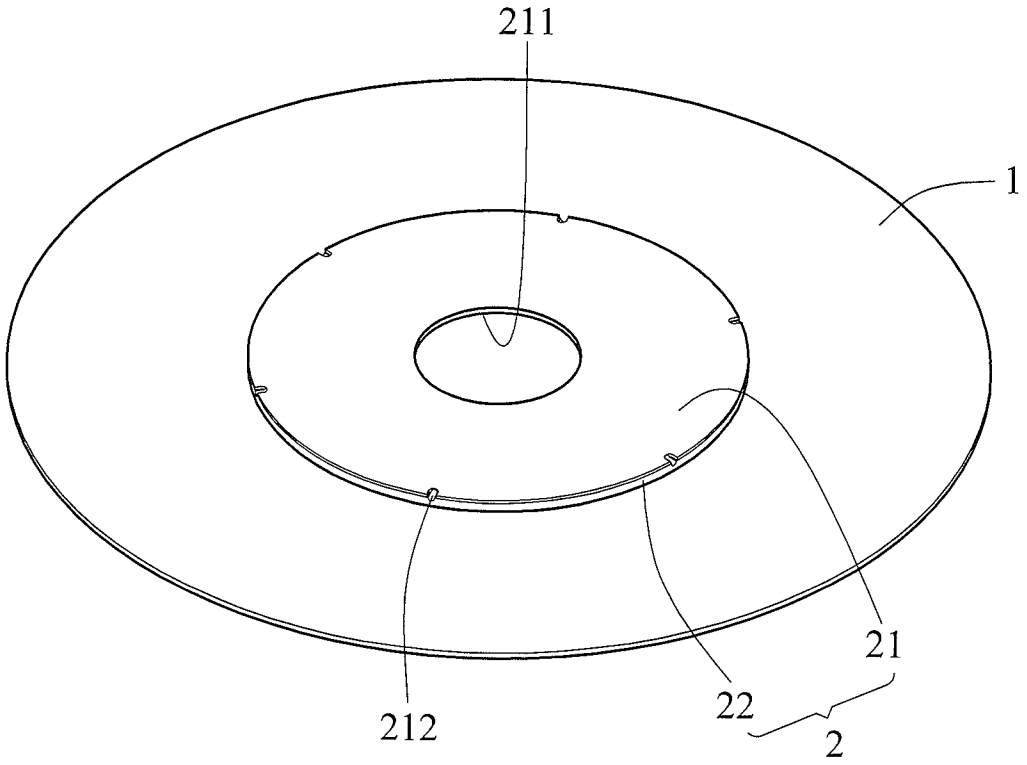
FIG. 1 is a perspective view of a mounting plate and a nozzle assembly of a container cleaning device according to the invention.
Figures 2, 2A, 2B:
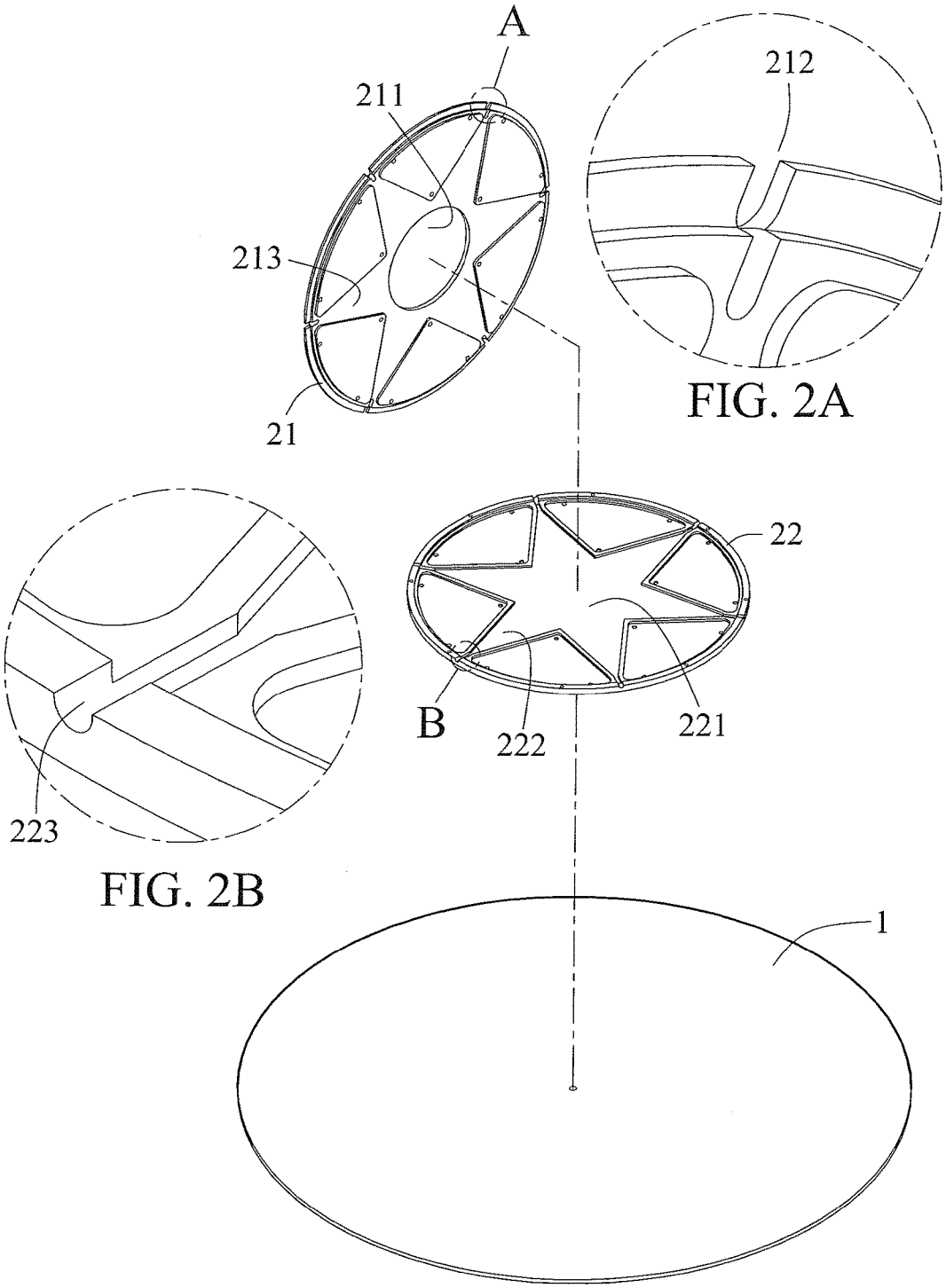
FIG. 2 is an exploded view of the mounting plate and the nozzle assembly.
FIG. 2A is a detailed view of the area in circle A of FIG. 2.
FIG. 2B is a detailed view of the area in circle B of FIG. 2.
Figure 3:
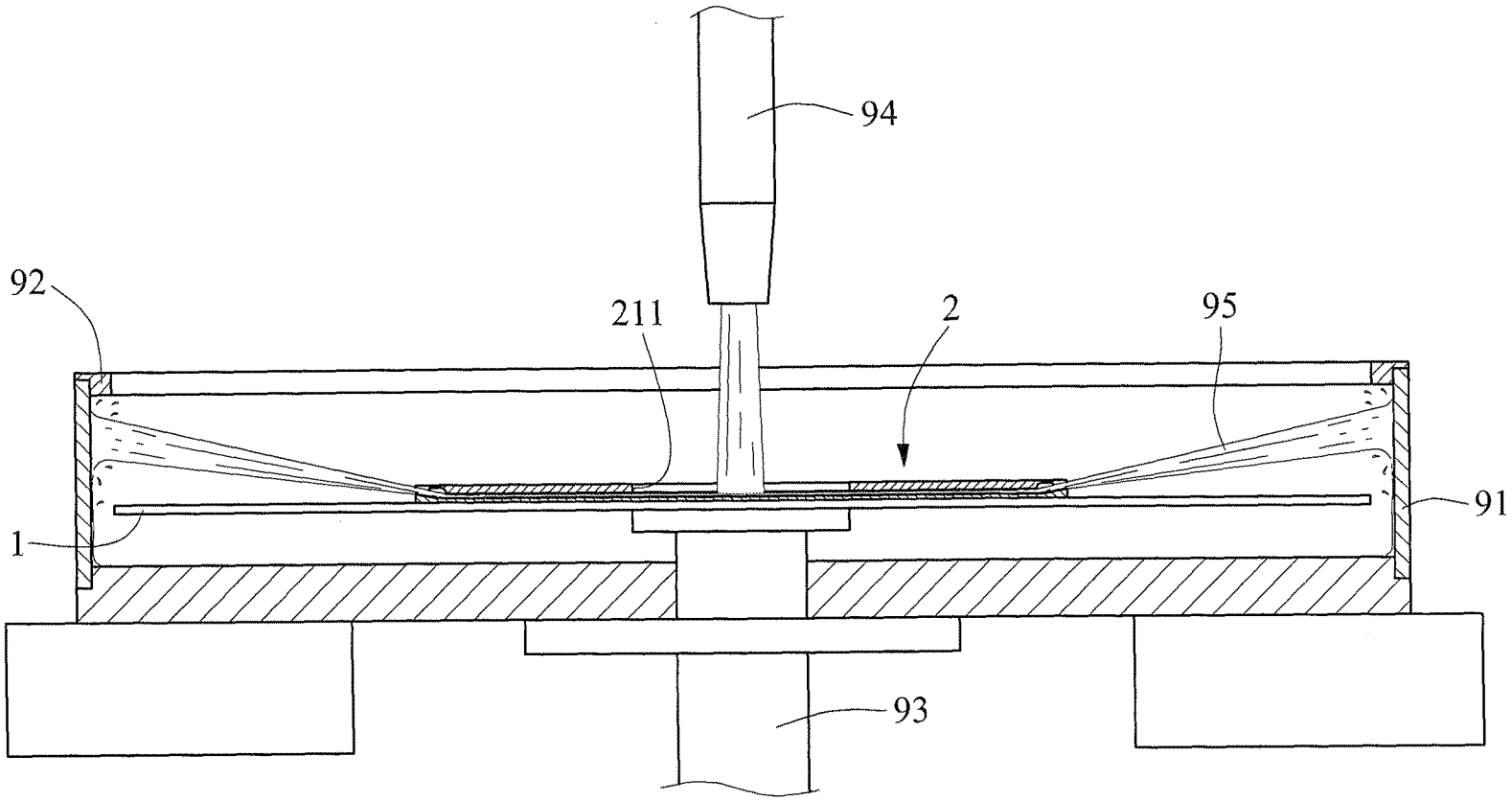
FIG. 3 is a longitudinal sectional view of the container cleaning device in a wafer cleaning operation.
Figure 4:
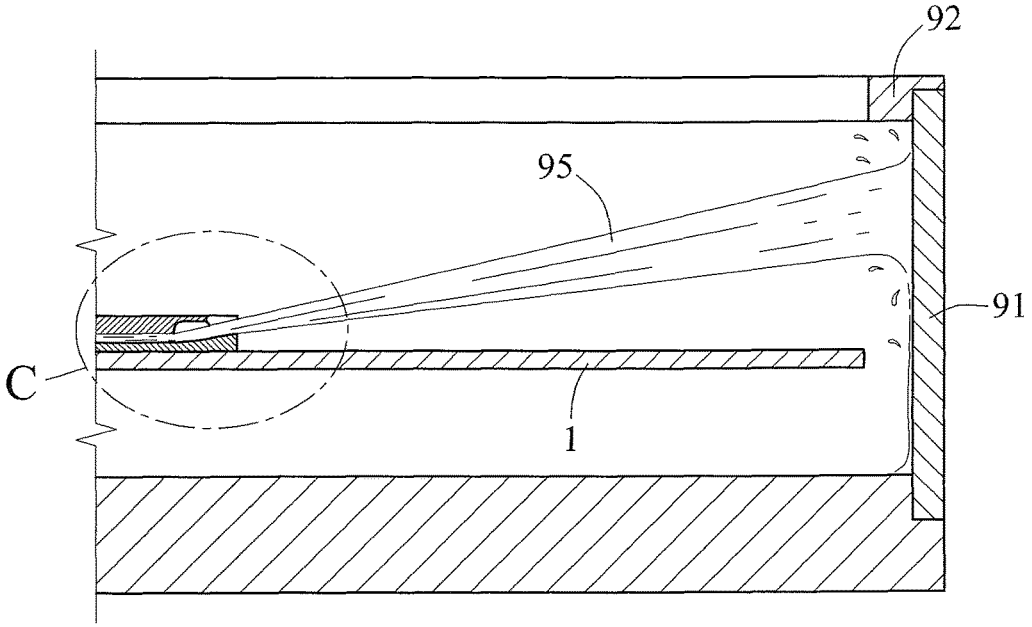
FIG. 4 is an enlarged view of the right side of FIG. 3.
Figure 5:
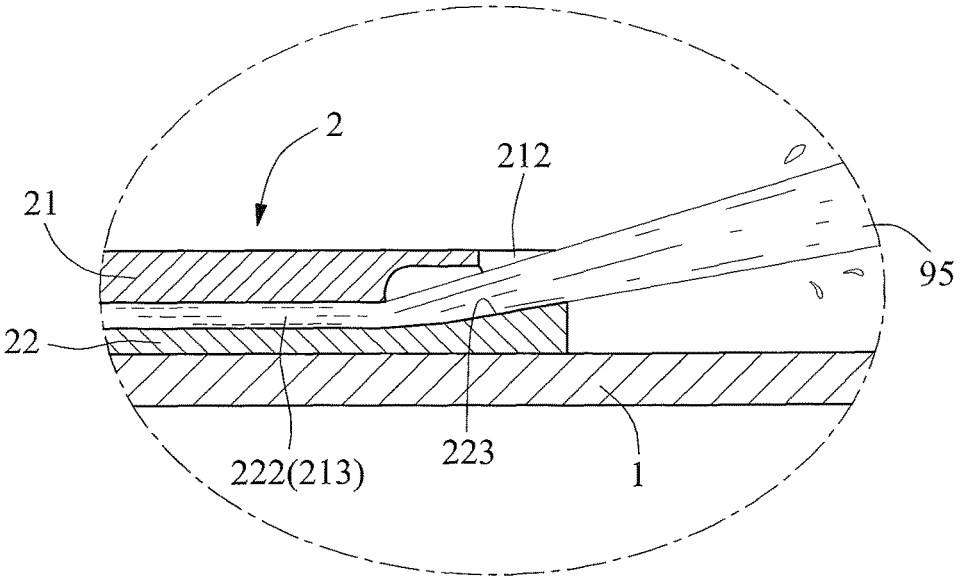
FIG. 5 is a detailed view of the area in oval C of FIG. 4.
Figure 6:
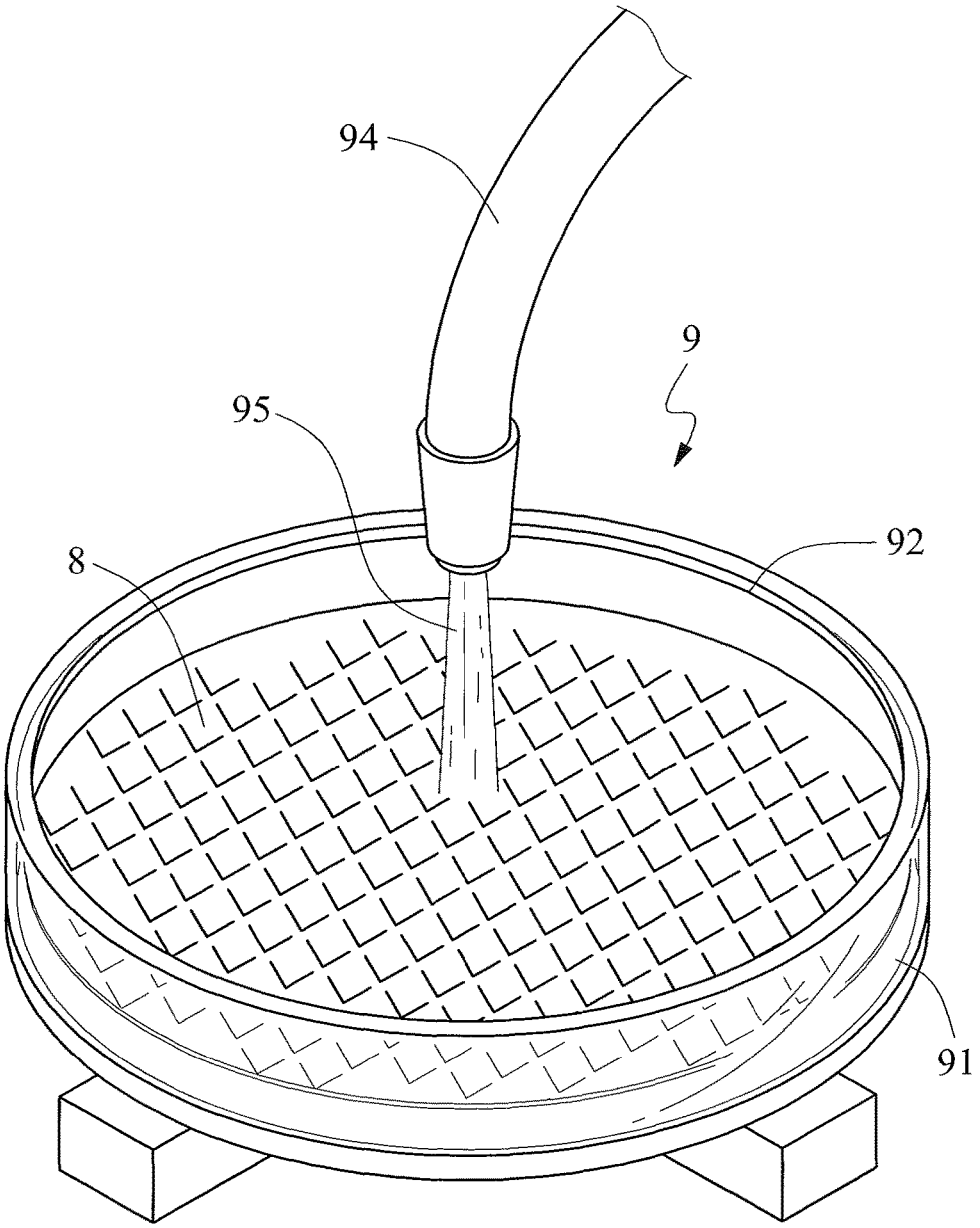
FIG. 6 PRIOR ART
FIG. 6 is a perspective view of a conventional container cleaning device.
Figure 7:
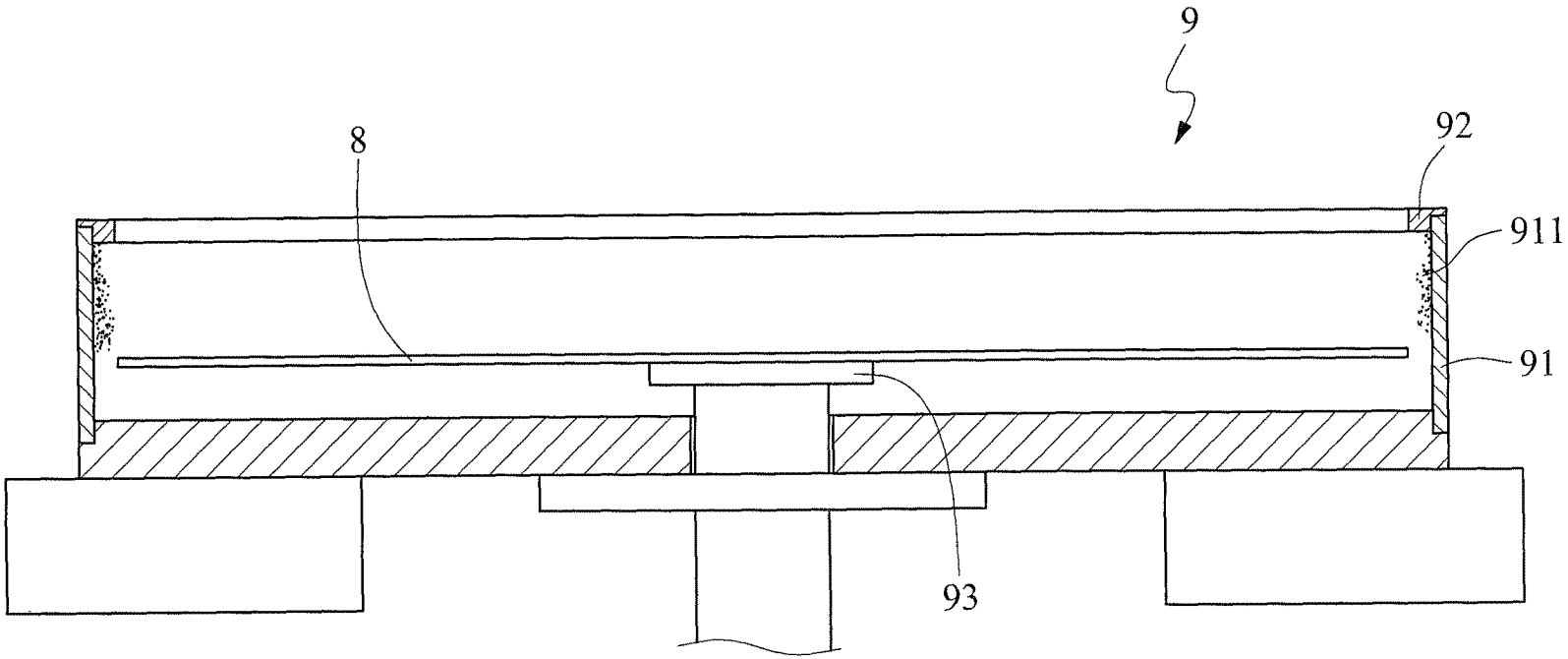
FIG. 7 PRIOR ART
FIG. 7 is a longitudinal sectional view of the container cleaning device of FIG. 6.

Referring to FIGS. 1 to 5, a container cleaning device in accordance with the invention comprises a disc shaped mounting plate 1 for accommodating a wafer, and a nozzle assembly 2 disposed on the mounting plate 1 and including a disc shaped base 22 and a ring shaped shell 21 on the base 22. The shell 21 includes a central inlet 211, a plurality of outlets 212 on an edge, and a plurality of wedge shaped channels 213 on a bottom, the channels 213 being disposed between the inlet 211 and the outlets 212 and communicating the inlet 211 with the outlets 212. The pointed portion of the channel 213 terminates at the outlet 212 and the wider portion thereof terminates at the inlet 211. The base 22 includes a central recess 221, a plurality of outlets 223 on an edge, and a plurality of wedge shaped channels 222 between the recess 221 and the outlets 223 and communicating the recess 221 with the outlets 223. The pointed portion of the channel 222 terminates at the outlet 223 and the wider portion thereof terminates at the recess 221. The outlets 223 are adjacent to the outlets 212.

Preferably, the outlet 223 is inclined at an angle between 10-degree and 90-degree with respect to the channel 222.

Alternatively, the channels 213 are eliminated in another embodiment.

Alternatively, the channels 222 are eliminated in another embodiment.

The container cleaning device further comprises an open container 91, a cover 92 adapted to put on the container 91, a rotatable support 93 in the container 91, and a pipe 94. The mounting plate 1 is placed on the support 93.

After polishing wafers in the container 91 a plurality of times, the container 91 is required to clean because scale may form on an inner surface of the container 91. In the cleaning step, the support 93 rotates in high speed to rotate both the mounting plate 1 and the nozzle assembly 2. Also, cleaning solution 95 exits the pipe 94 to flow into the inlet 211. And in turn, the cleaning solution 95 flows to the outlets 223 via the channels 222, 213. The cleaning solution 95 is accelerated to generate thrust due to the strong centrifugal force of the mounting plate 1 and the nozzle assembly 2 and decreased cross sectional area of the channels 222, 213. The high pressure cleaning solution 95 spatters on the inner surface of the container 91 to remove the scale from the inner surface of the container 91.

It is envisaged by the invention that the container cleaning operation can be performed after polishing wafers without stopping the producing processes. Thus, the production cost is greatly decreased.

While the invention has been described in terms of preferred embodiments, those skilled in the art will recognize that the invention can be practiced with modifications within the spirit and scope of the appended claims.

What is claimed is:

1. A container cleaning device comprising:

a mounting plate shaped for accommodating a wafer; and a nozzle assembly including a base located on the mounting plate and a shell complimentarily disposed on the base;

wherein the shell includes an inlet in a central portion and at least one outlet at an edge and in communication with the inlet;

wherein the base includes a recess in a central portion and at least one outlet at an edge and in communication with the recess; and wherein the recess is in communication with the inlet so that the recess receives a downward water jet through the inlet, wherein the at least one outlet of the shell is in communication with the at least one outlet of the base, thereby providing at least one outward and upward passageway adapted for turning the downward water jet into at least one outward and upward water jet.

2. The container cleaning device of claim 1, wherein the shell further comprises a channel assembly on a lower face between the inlet and the at least one outlet thereof and adapted for communicating the inlet with the at least one outlet thereof.

3. The container cleaning device of claim 2, wherein the channel assembly is tapered from the inlet toward the at least one outlet of the shell.

4. The container cleaning device of claim 1, wherein the shell further comprises a channel assembly on a lower face between the inlet and the at least one outlet thereof and adapted for communicating the inlet with the at least one outlet thereof; and the base further comprises a tunnel assembly on an upper face between the recess and the at least one outlet of the base.

5. The container cleaning device of claim 4, wherein the tunnel assembly is tapered from the recess toward the at least one outlet of the base.

6. A container cleaning device comprising:

a nozzle assembly including a base and a shell complimentarily disposed on the base;

wherein the shell includes an inlet in a central portion and at least one outlet at an edge and in communication with the inlet;

wherein the base includes a recess in a central portion and at least one outlet at an edge and in communication with the recess; and wherein the recess is in communication with the inlet so that the recess receives a downward water jet through the inlet, wherein the at least one outlet of the shell is in communication with the at least one outlet of the base, thereby providing at least one outward and upward passageway adapted for turning the downward water jet into at least one outward and upward water jet.

7. The container cleaning device of claim 6, wherein the shell further comprises a channel assembly on a lower face between the inlet and the at least one outlet thereof and adapted for communicating the inlet with the at least one outlet thereof.

8. The container cleaning device of claim 7, wherein the channel assembly is tapered from the inlet toward the at least one outlet of the shell.

9. The container cleaning device of claim 6, wherein the shell further comprises a channel assembly on a lower face between the inlet and the at least one outlet member and adapted for communicating the inlet with the at least one outlet member; and the base further comprises a tunnel assembly on an upper face between the recess and the at least one outlet of the base.

10. The container cleaning device of claim 9, wherein the tunnel assembly is tapered from the recess toward the at least one outlet of the base.

* * * * *